US010555562B2

(12) United States Patent
Poirier

(10) Patent No.: US 10,555,562 B2
(45) Date of Patent: Feb. 11, 2020

(54) GARMENT FOR BREAST SUPPORT

(71) Applicant: Karen Daehnick Poirier, Allison Park, PA (US)

(72) Inventor: Karen Daehnick Poirier, Allison Park, PA (US)

( * ) Notice: Subject to any disclaimer, the term of this patent is extended or adjusted under 35 U.S.C. 154(b) by 314 days.

(21) Appl. No.: 15/788,018

(22) Filed: Oct. 19, 2017

(65) Prior Publication Data

US 2019/0116890 A1 Apr. 25, 2019

(51) Int. Cl.

| | |
|---|---|
| ***A41C 1/06*** | (2006.01) |
| ***A41C 1/10*** | (2006.01) |
| ***A41D 27/24*** | (2006.01) |
| ***A41C 3/08*** | (2006.01) |
| *A41D 10/00* | (2006.01) |

(52) U.S. Cl.

CPC ..... *A41C 1/06* (2013.01); *A41C 1/10* (2013.01); *A41C 3/08* (2013.01); *A41D 27/24* (2013.01); *A41D 10/00* (2013.01)

(58) Field of Classification Search

CPC .... A41C 1/08; A41C 1/06; A41C 1/10; A41D 27/24

USPC ..... 450/11

See application file for complete search history.

(56) References Cited

U.S. PATENT DOCUMENTS

| | | | | | |
|---|---|---|---|---|---|
| 1,890,507 | A * | 12/1932 | Gifford | A41C 3/08 | 450/31 |
| 2,497,938 | A | 2/1950 | Werther | | |
| 3,316,915 | A | 5/1967 | Howell | | |
| 4,698,847 | A * | 10/1987 | Yoshihara | A41B 9/08 | 2/406 |
| 8,585,458 | B2 | 11/2013 | Armanino | | |
| 2004/0133959 | A1* | 7/2004 | Horii | A41B 9/06 | 2/69 |
| 2011/0214216 | A1* | 9/2011 | Zarabi | A41D 27/02 | 2/69 |
| 2013/0045661 | A1* | 2/2013 | Armanino | A41C 3/08 | 450/31 |
| 2014/0141692 | A1* | 5/2014 | Yuasa | A41C 3/08 | 450/30 |

* cited by examiner

*Primary Examiner* — Gloria M Hale

(74) *Attorney, Agent, or Firm* — Kathleen Kuznicki; The Lynch Law Group, LLC

(57) ABSTRACT

The disclosed garment is uniquely constructed to provide stretchable, comfortable, non-binding night-time breast support to large-breasted women without any horizontal bands or binding around the chest or middle of the body. It effectively addresses the 3-way support needs (up, in, and apart) providing a garment that is robustly supportive, creating a pleasing shape and silhouette, while being comfortable, breathable, and not constrictive in any way using no wires and no horizontal banding around the chest and torso.

21 Claims, 2 Drawing Sheets

GARMENT FOR BREAST SUPPORT

FIELD OF THE INVENTION

Nightwear/leisure garment suited especially for women with larger breast sizes.

BACKGROUND

"The average bra size has jumped from 34B in 1993 to a 34E in 2013, according to a new survey by lingerie retailer intimacy" http://www.huffingtonpost.com/2013/07/24/bra-size-survey_n_3645267.html This change in body demographics means that nowadays more women have larger, heavier breasts. For many women, especially those with larger, heavier breast sizes, finding nightwear comfortable enough in which to sleep is a challenge. While a long T-shirt or a night shirt is comfortable for many people, these items do not provide any breast support that is desired by most women; especially larger breasted women. There are two predominant designs for "supportive" nightwear: (a) those that are "sleep bras" or involve integrated bras (usually soft cup bras with back- or front-hook closures, and other hardware such as underwires) or (b) those offering "shelf bra" support failure, a horizontal band of elastic cutting across the chest and/or around the whole torso. While these designs may provide some partial breast support, the support is binding and presses into the body leading to discomfort making it difficult to sleep for most women. This binding can lead to medical issues such as the aggravation of indigestion, GERD or reflux-type issues. These issues are frequently experienced by large-breasted women because of tight bra bands, especially while lying down or sleeping.

One design to eliminate the integrated bra and the horizontal band can be seen in U.S. Pat. No. 3,316,915. Disclosed in U.S. Pat. No. 3,316,915 a nightgown with a bust support comprising a back portion made from a highly resilient and stretchable material, the back portion material being substantially continuous with the shoulder straps, and a front portion with a midriff section located underneath and supporting the breast cups that is made from a relatively inelastic or a stiff material. Though this design is snug and provides limited support, due to the inelasticity, it is still not comfortable. The design disclosed in '915 essentially offers stretch only across the back and in the straps (25, 28, 30), while the under-bust support offered by lower cup segment 32 and front midriff section 38, is recommended to be constructed of "a double-ply of non-elastic tricot." This design is illogical, since this means the garment offers no stretch at all in the lower cups and front section, resulting in poorer fit and less comfort, and a much smaller range of accommodation of breast sizes and shapes. Larger breasts would fall or spill out of both aforementioned designs. Meanwhile, the free-flowing front panel 10 offers no support or shaping around the torso. The disclosed '519 garment was designed for when the average woman weighed 140 lbs. (1960 statistic). Today, women are larger. The average weight of women today (2011-2014) is 168.5 lbs., an increase of 20 lbs. or 14%. In addition, between 2011-2014, 38% of adult women were obese. '519 was filed in a time when average breast sixes were considerably smaller and with less of an overall range. While this design might accommodate breasts with cup sizes ranging from A to 8, possibly C, the fit and support would decrease in effectiveness as the cup size increased. The '519 garment would still be uncomfortable, would not stretch in the lower cups and front section. '519 was never designed for, and would be useless for, cup sizes of D and above, it would offer neither fit, comfort, nor support for these much heavier and more voluminous breasts.

Another design that does not utilize an integral bra or horizontal band is seen in U.S. Pat. No. 2,497,938, which discloses a slip to be worn under clothing. The design has a priority on maintaining a smooth surface under clothing to avoid bulkiness at the waistline and elsewhere, i.e. on the slip not riding up or twisting, '938 claims: "an improved combination slip and brassiere and claims that "elastic tension across the back [in combination with] the tension on the shoulder straps, produces a perfectly fitting garment"; "The bust portion of the garment is . . . molded by the tensions along the side seams . . . and the upward tension of the shoulder straps"; and "Bust panel is of non-elastic material and the back elastic panels pull "downwardly and upwardly respectively on the upper and lower portions of the bust pockets so as to shape the same and to produce a confining, uplift action." The garment disclosed in '938 not meant to be worn on its own and there is little to no breast support. The idea that the "downward and upward pull" of the elastic back on the bust pockets will somehow provide an "uplift" action is physically impossible. Since the front breast panels of the garment have no horizontal seaming, at best—and assuming a very tight fit—the above-referenced upward/downward pull of the rear elastic combined with the non-elastic breast pocket would effectively just push breasts against the body "as they lie". In other words, while the garment may offer a modicum of "confining" action if it is tightly fitted, there is no built-in structure offering upward lift to fight the pull of gravity downwards on the breast, nor any structured seaming around the outside curve of the breast to provide any side-inward support to counteract "side spillage" from the front compaction of the breasts by the non-elastic front breast panels. Furthermore, the non-elastic breast panels provide no center-anchoring between the breasts in the front of the garment, so there is no structure to hold the breasts in place individually, and no breast definition. This creates an undefined "uni-boob" mass across the front for breast cup volumes larger than an A or B cup. In addition, this design offers no consideration for the wearer's comfort. As designed and described here, the non-elastic front panels confine the breasts. For this to be true, the garment must fit very tightly, thereby smooshing the breasts against the body, which results in chafing and sweating of the breasts (especially larger breasts) if the fit is tight enough to provide confinement. Alternatively, if the garment fits loosely enough to be comfortable, it would not hold the breasts in place and would result or significant movement of the unsecured breasts up-and-down and side-to-side. The '938 design was filed in a time when average breast sizes were considerably smaller and the range in size was less. It might accommodate breasts with cup sizes ranging from A to B, possibly C, with the fit and support decreasing in effectiveness as the cup sire increased. It was never designed for—and would be useless for—cup sizes of D and above, and would offer neither fit, comfort, nor support, for these much heavier and more voluminous breasts.

Another purported design for a garment that gives breast support and comfort can be found in U.S. Pat. No. 8,585,458. The garment has a "Breast Support Housing" that is essentially an integrated bra, which depends upon an elastic band around the rib cage for the insignificant "shelf bra"-type support it provides. This still results in uncomfortable chafing and pressure around the rib cage. The "loose, unstructured nested areas or pockets" for the breasts are the only differentiator from other shelf-bra type products. Since the pockets do not provide any inward, forward or upward lift of the breast tissue, effectively the only thing the product provides is breast separation, by directing each breast into a pocket. However, there is no shaping or supporting of the breast against the downward pull of gravity.

While there is some light support provided by the "holding" action of the breast pockets, the pockets are unseamed and unmolded, and therefore the breast tissue spills in a natural, gravity-defined shape so that the visual profile provided by the product is still in effect, a bra-less one, and so it does not adequately address the modesty factor, as it purports to. Also, the pockets are designed for "bell" shaped breast and will not work as effectively for different breast shapes (firmer, rounder, pointier or narrower set).

Recent research by innovators in lingerie has documented 6 distinct breast shape type: https://www.thirdlove.com/pages/fit-finder #/breast_shape_question The different breast shapes present different fit challenges with increasing complexity as breast size and volume increases. This creates a need in the apparel arts for a garment that offers more robust support to the breasts, including not only under-breast support, but also inside- and outside—side support to hold the breasts not only "up" but also "in" and "apart" (3-way support). Also, the need today, to accommodate a larger volume of breast tissue means needing cups that expand in every direction—not only on the upper half of the breast, but around the full circle of the breast, underneath and around.

To date, no "leisure" garment meets this unique 3-way support challenge without resorting to bra-like construction with a tight, constrictive, often hooked band around the ribcage, and significant seaming or wiring around the cups (sacrificing comfort); OR 'loose support' such as the "shelf bra" which creates discomfort by binding around the chest and torso, and which does not offer enough hold or structure even to comfortably hold the breast up (fighting gravity), let alone to hold the breasts in (so as not to spill out to the sides) nor to shape the breasts in an attractive way.

What is needed is nightwear or a leisure garment that provides 3-way support as described above in which there is no "bra", rid built-in horizontal shelf band, no hooks, no hardware, and no underwires, but still provides adequate breast support, and is comfortable, especially for women with larger, heavier breast sizes so as to allow them to sleep.

SUMMARY OF THE INVENTION

Disclosed is a garment that provides not only under-breast support, but also, inside- and outside—side support to hold the breasts "up" but also "in" and 'apart' (3-way support). The 3-way support in the disclosed garment not only provides women with a garment that is comfortable, but also one that creates a pleasing, supported silhouette which is both attractive and allows for modesty (i.e. it is not obvious that the woman is braless). On the garment, one end of a support band is secured by an anchor seam on one side of the garment running under the underside of a breast cup on the same side of the garment to a release point approximately two inches below the midpoint of the garment. A second end of a support band attaches the opposite side on a top front panel/back panel interface via a shoulder anchor seam. The support bands give under-breast support holding the breasts "up". Support bands are each constructed of a single, long stretch of fabric which is sewn together like a tube of fabric to provide the double-heft which gives them good strength and stability to provide additional lift to the breasts. At the release point where the support bands detach from the breast cup to their attachment at the should anchor seam, the support bands 'float' along a detached pathway allowing for the bands to stretch as needed to accommodate varying breast sizes, and different shoulder widths, heights, and angle of slope, which vary from woman to woman, who may have similar sized physiques but different breast sizes. The design also allows for an individual woman's own changing breast size that may vary over the course of time due weight loss/gain, monthly cycles, pregnancy, water retention, etc. Each breast cup on the garment is comprised of an inner breast panel (single fabric piece) and an outer breast panel (double fabric piece) connected via a single, curved, mostly vertical seam. This allows the breast cup to gently shape the breast, and allows for heavier support from the outside to the inside utilizing the double fabric piece outer breast panel. This construction directs the breast volume forward rather than sideways, therefore holding the breasts "in". The single fabric inner breast panel allows ample stretch to accommodate the volume of the breast directed forward from the side. Each breast having its own breast cup and support band housing also allows the breasts to stay "apart". The vertical, bodice paneling provides strong and stable support for the breast cup and support band seaming. The entire garment is stretchable so it can be easily pulled on overhead. No fasteners, hooks, or strap adjustment is required.

SHORT DESCRIPTION OF THE FIGURES

DESCRIPTION

Disclosed is a nightwear or leisure garment in which there is no "bra" and there, is no built-in horizontal shelf band, but still provides for adequate 3-way breast support, especially for women with larger breast sizes. The disclosed garment preferably accommodates sizes D and above, though size C and smaller area also contemplated by this disclosure. The disclosed garment accommodates larger breast volume because it is designed to allow the breast cups to expand in every direction—not only on the upper half of the breast, but around the full circle of the breast, underneath and around. Due to its unique design and construction, the disclosed garment effectively addresses the 3-way support needs (up, in, and apart) in a garment that is robustly supportive, creating a pleasing shape and silhouette, while being comfortable, breathable, and not constrictive in any way, using no wires or no horizontal banding around the chest and torso.

The breast support has no hooks, no hardware, and no underwires. The garment is comfortable enough to allow a woman to sleep or to just have a supportive yet modest garment to wear around. The wearer gets no indentation marks on her skin across or around her chest, stomach, or waist, as routinely would happen with hooked or shelf bra construction. This design also prevents the aggravation of indigestion, GERD or reflux-type issues that are frequently experienced by large-breasted women as a result of tight bra bands, especially while lying down or sleeping.

Figure 2:
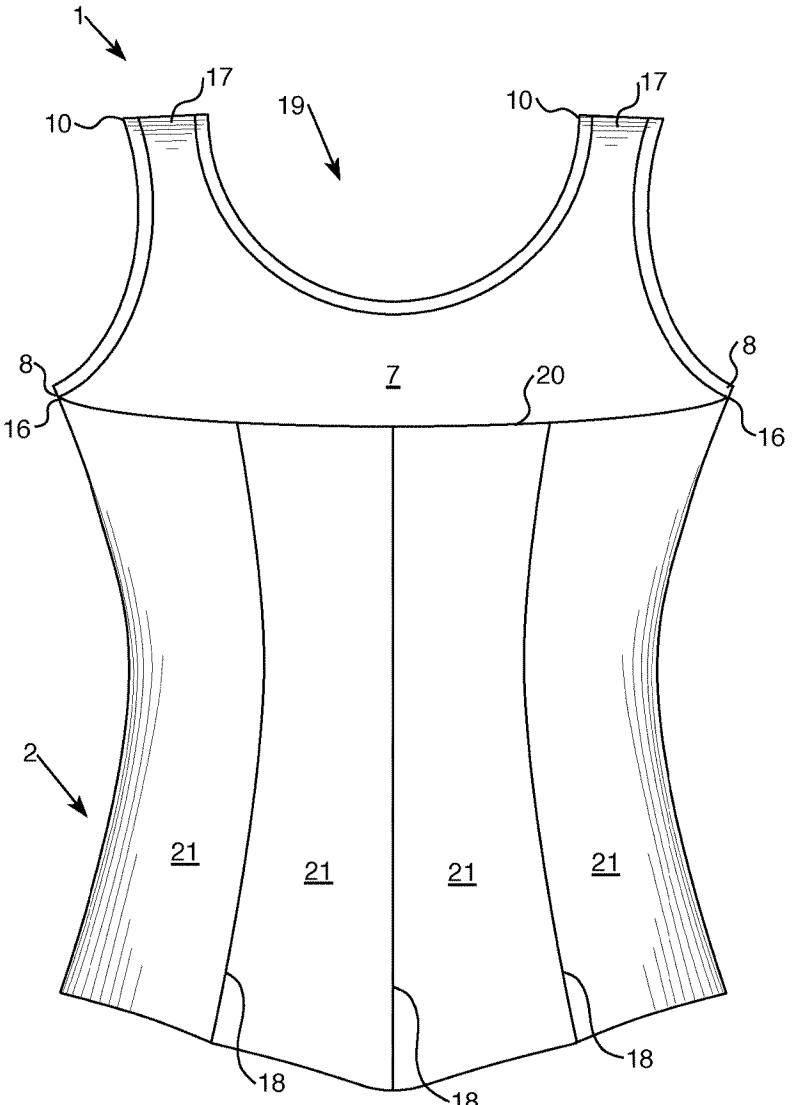
FIG. 2 shows back view of one embodiment of the garment.
Figure 1:
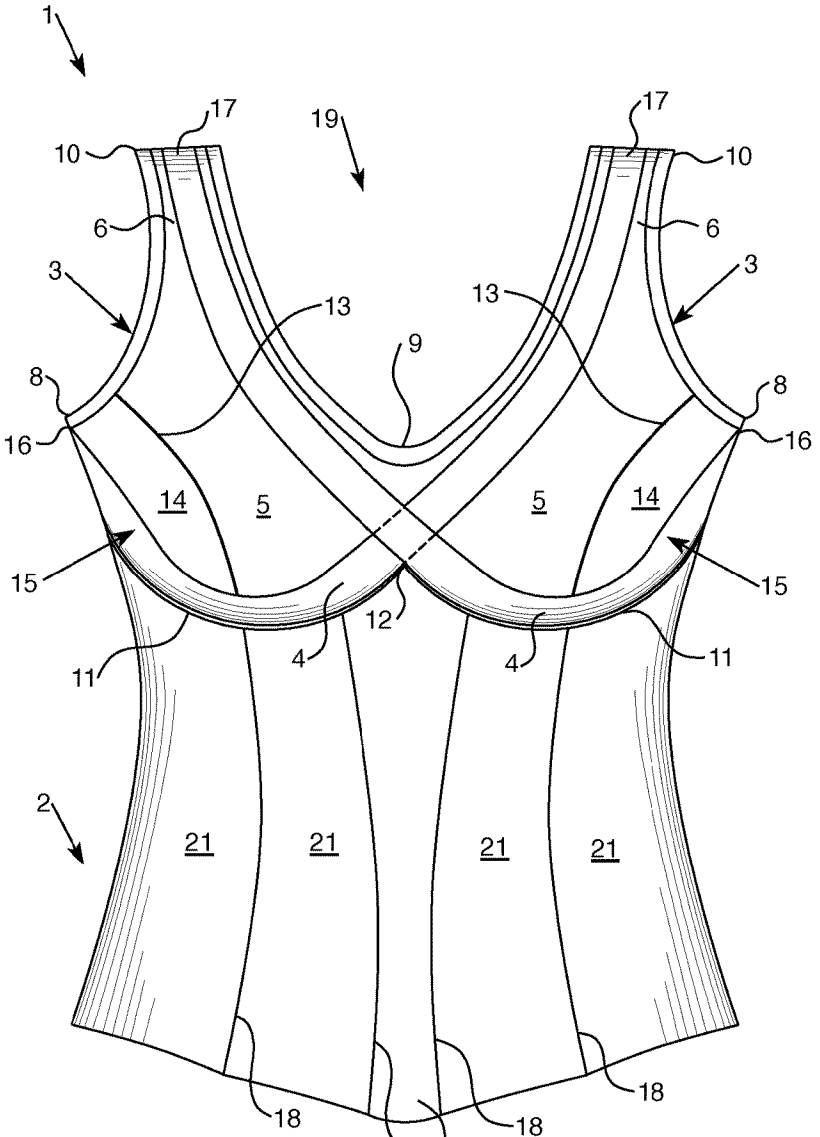
FIG. 1 shows front view of one embodiment of the garment.
Figure 3:
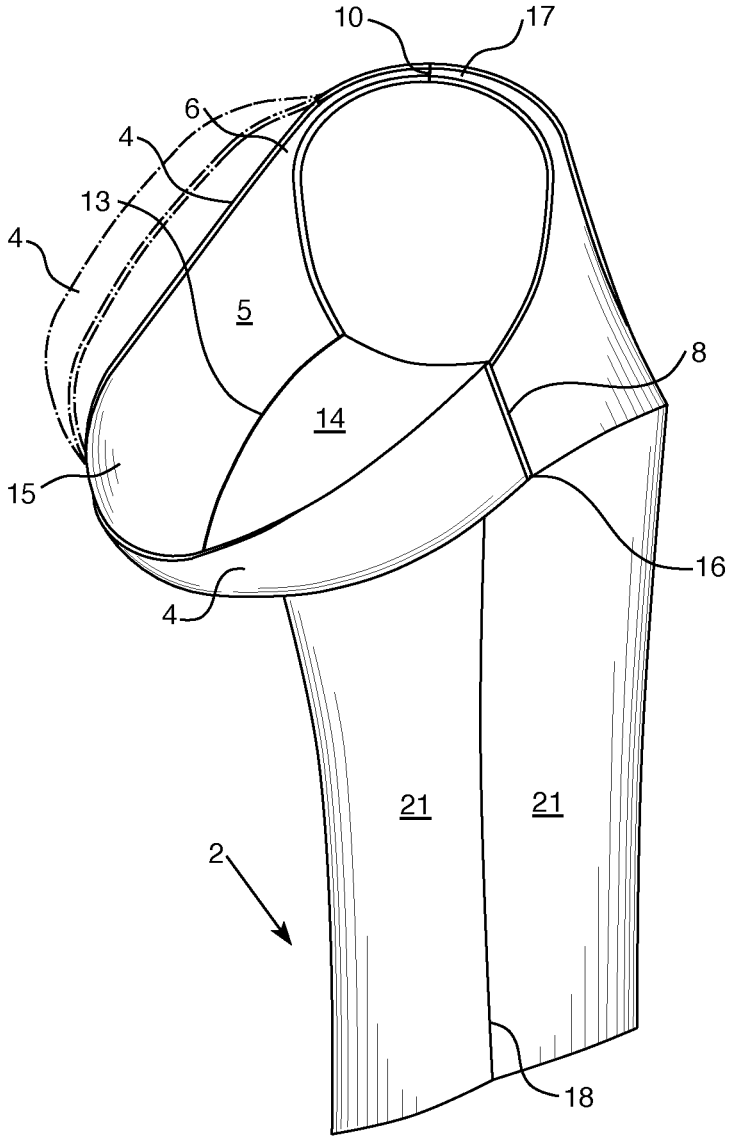
FIG. 3 shows side view of one embodiment of the garment.

FIGS. 1-3 show one embodiment of the garment. Garment 1 is comprised of bodice 2 with vertical panels 21 and center panel 22, each vertical panel 21 is separated from the other vertical panels 21 and from and the center panel 22 by vertical seaming 18, and upper portion 19 comprised of front panels 3, outer breast panels 14, and back, panel 7. Front panels 3 are structured from a single fabric piece that functions as an inner breast panel 5 and a front strap 6. Inner breast panel 5 extends from approximately the center of the chest to a point past the midline of the breast which is approximately the mid-point between the midline and the outer edge of the breast. Outer breast panel 14 extends from the mid-point between the midline and the outer edge of the breast to the outside of the breast under the arm at the outer breast cup panel/back panel interface 16 and connects to inner breast panel 5 via curved seam 13, to form breast cup 15. Each outer breast panel 14 is a doubled piece of fabric (i.e. double pattern pieces are cut and then sewn together and the seam turned inward before being attached to the other garment pieces). The upper portion 19 of the garment 1 is further comprised of support bands 4. One end of each support band 4 attaches to the outer breast panel/back panel interface 16 via side anchor seam 8, and a second end of support bands 4 attaches the opposite side top front panel/back panel interface 17 via shoulder anchor seam 10. Support bands 4 are also attached to breast cups 15 via under-breast seam 11 which continues from the side anchor seam 8 and runs up to approximately two inches below the mid-point 9 (mid-point of the front of garment) at release point 12 on the upper portion 19 of the garment 1. Preferably support bands 4 are detached from release point 12 to the top front panel/back panel interface 17 at shoulder anchor seam 10 (the detached pathway). This disclosure also contemplates support bands that are attached fully or partially along inner breast panel 5 and front strap 6. The back panel 7 is attached to the back of bodice 2 via back seam 20.

The housing design of breast cup 15 provides shape, support, and adequate volume for the curvature of a larger breast. Designs using a single piece of "flat" 2-dimensional fabric cannot adequately create a shape for the breast. If a single piece of fabric were used here, the breast tissue would just spread organically which would result in a less flattering breast shape due to lack of support holding the breasts inward from the outside. That is, the breasts would spread outward to the side resulting in a flabbier, wider silhouette. The curved seam 13 in the breast cup 15 gently shapes the breast, and allows for stronger support from the outside to the inside utilizing the doubled piece outer breast panel 14, directing the breast volume forward rather than sideways. The single-panel fabric of front panel 3 then allows ample stretch to accommodate the volume of the breast directed forward from the side. Support bands 4 are each constructed of a single, long stretch of fabric which is sewn together like a tube of fabric to provide the double-heft which gives them good strength and stability to provide additional lift to the breasts. As they travel from anchor side seam 8 to release point 12, the seams of the tube are hidden (interior seams). At release point 12 where the support bands 4 detach from the breast panels and "float" from there to their anchor point (shoulder anchor seam 10), the seam is turned inward and pressed, so that the support bands 4 have a smooth feel and finished look, lying flat across the chest and décolletage. Preferably, support bands 4 are approximately 2¼ inches wide at the side anchor seam 8 on the outer breast cup panel/back panel interface 16, gradually tapering as they curve under the breast to approximately 1¼ inches where they release from the under-breast seam 11 at release point 12 and travel to the opposite side top front panel/back panel interface 17 via shoulder anchor seam 10. However, this disclosure contemplates non-tapered support bands, as well as band widths ranging from approximately 1-3 inches. Specific lengths and widths of specific pieces of the garment will vary according the sizes being produced to accommodate the various sizes of women from petite to plus sizes.

Another embodiment of the garment uses an alternative bodice design whereby the entire front of the bodice is comprised of only one single piece of fabric and not individual panels. This allows for the bodice to be less structured and may be more conductive for expecting mothers to allow for the expansion that comes with the round, profile of a pregnancy. This seamless version will not cause irritation to the sensitive skin of a woman's pregnant belly. This single front panel may also include at the bottom of the garment a belly band which is a horizontally-running doubled-fabric band (similar in construction to the support bands) that runs horizontally and curves underneath the belly. This belly band may provide a gentle upward lift support to the belly. The upper portion of the garment remains the same as described above and below.

The entire garment is preferably constructed of a moderately heavyweight cotton-spandex (most preferred 95%-5%) fabric with 4-way stretch fabric to provide comfort as well as strength and stability. Four-way stretch fabric is defined in this disclosure as a fabric that stretches and recovers both on the cross and lengthwise grains. Cotton is the most preferred base material as it offers the best comfort and breathability, though other fabrics that are breathable such as a rayon or modal blend with lycra/spandex (5-7%) for stretch are contemplated by this disclosure. Ponte weight fabrics or silk blends are also alternative options. The key is that the fabric must be strong and stable and have enough weight/heft to provide firm support even as the stretching allows the garment to expand and comfortably conform to the body. Alternatively, when the weather is warm, a sports mesh fabric may be substituted in for fabric panels that are not critical for structural support such as front panel 3 or any of the panels 21.

Preferably, the outer'breast panels 14 and support bands 4 are constructed with double fabric panels to provide the necessary extra support. The garment-spanning support bands 4 are anchored in two ways: at side anchor seam 8 between the outer breast panel 14 and the back panel 7 at the outer breast panel/back panel interface 16, from which they are continuously anchored into and all along the under-breast seam 11 until releasing from the under-breast seam 11 approximately two inches before midpoint 9 at the release point 12 on the upper portion 19 of garment 1, where they cross to the opposite side of the body; from the release point 12 the bands are not bound to the upper portion 19 of the garment 1. Releasing from the under-breast seam 11 approximately two inches before midpoint 9 at the release point 12 in the upper portion of the garment at this point allows the bands to stretch as needed to accommodate varying breast sizes—not only from woman to woman but also to accommodate a woman's own changing breast, size throughout weight gain/weight loss/monthly cycles/water retention/etc. and also to accommodate the common phenomenon of one breast slightly larger or smaller than the other. The support bands 4 are then secured on the opposite shoulder at the second anchor point via shoulder anchor seam 10 at top front panel/back panel interface 17. Additionally, the garment 1 may be further comprised of a means to attach the support bands 4 loosely at a plurality of points along the otherwise detached pathway that runs along the under-breast seam 11 at release point 12 to the opposite side top front panel/back panel interface 17 via shoulder anchor seam 10. The means to attach at any single point would still allow the support bands 4 to nave the freedom to stretch as needed to accommodate varying breast site, but also allow the support bands 4 to be gently held closer to the line of inner breast panel 5 so as not to create an aesthetically undesirable gap showing skin between the support band 4 and front panel 3. Any means to attach known in the art can be used, some examples include but are not limited to a small "invisible" loops of thread or elastic thread in a matching color (with enough room for movement) anchored at one or more points along the front panel hidden under the support bands, attached to the back of the support band but sewn so as not to pass fully through the front-facing thickness of the support band, thus invisible from the front; stretchable decorative trim attached to both the support band and the front panel; small decorative charms made of metal, plastic, or fabric which are visible from the front of the support bands and which anchor, cover and hide loops of thread or elastic that pass through both the band and front panel; or a ribbon that "laces" its way down each front panel and strap (weaving through both) and meeting at release point 12 where it ties in a bow.

The garment has a bodice 2 with panels 21 connected entirely with vertical seaming 18, and breast cups 15 with only one, curved seam 13. Each pattern piece of the garment is strategically cut—either with the fabric grain or against it—depending on its function to maximize support where needed or to maximize stretch where needed. Depending on the fabric, it may stretch more with the grain or against it, so the stretch must be tested and the pieces cut and oriented based on the direction of more stretch. All pattern pieces—bodice panels 2, front panel 3 outer breast panels 14, back panel 7, and support bands 4 must be oriented and cut accordingly to allow for more stretch in the side to side orientation (around the bodice and breasts) than in the vertical orientation. This allows the garment to conform comfortably to a variety of torso and breast sizes without confining or constricting around the chest and torso, while offering the ideal amount of stability and strength for gravity-fighting vertical lift. This is also the reason why each the outer breast panel 14 is a doubled piece, providing extra support around this side portion of the breast—to help position it forward—even as the direction of the grain allows for comfortable stretch and expansion.

The stitches used in the various seams the garment are as follows:

1) The vertical seaming 18 is zig-zag, flatlocked, or serged. This allows stretch and minimizes bulk to maximize comfort and provide a slim silhouette
2) Curved seam 13 is zigzag stitched to provide strength and stretchability to the triple fabric seam (outer breast panel 14 joining to front breast panel 3)
3) The shoulder anchor seam 10 and side anchor seam 8 are straight-stitched so that they will NOT stretch. These seams provide anchoring for the support of the garment.
4) The back panel 7 is zig-zag stitched to the back of bodice 2 via back seam 20, allowing for strength, stability and stretch.
5) The under-breast seam 11 in breast cups 15 are zig-zag stitched to allow for strength, stability and stretch.

As used here, the terms "flatlocked" and "serged" are virtually interchangeable . . . they are both a stretchable zig-zag stitch which have no rough seam edges. The edges are timed and "locked" within the seam stitching. Anchor seams are NOT flatlocked because there are multiple pieces of fabric coming together in one place and this does not lend itself to the flatlock and the stability of a straight stick is required.

All internal seams touching sensitive skin (such as under the breasts and underarms) are finished by being bound in a soft stretch-cotton seam binding to create an "invisible" feel and to prevent chafing. The edges are tightly trimmed and enclosed within the soft binding fabric over the seam edges, so it is neat and flat on both the inside and the outside, and also allows for stretching. There is no skin irritation because only the fabric—and no unfinished seaming—touches the skin in these sensitive areas. In addition to the seams discussed above, the under arm armhole area is self-edged with an interior seam (not shown) that attaches the two identical pattern pieces that form the doubled piece outer breast panel 14. Optionally, for decorative purposes, elastic edging or seam binding, can be added to the upper border of the font and back of the garment, and the upper shoulder portion of the armholes (passing over the shoulder from curved seam 13 in the front to anchor seam 8 at the side). This still leaves the under-arm armhole area clear and comfortable (the self-edged area with the internal seam of outer breast panel 14).

The garments unique combination of fabric type (cotton spandex) and weight (moderate-heavy to provide needed hold), vertical seaming, and vertical and body-spanning support bands results in a garment that is highly supportive and yet as comfortable as a second skin, with no horizontal binding elements. That means the wearer gets no indentation marks on her skin across or around her chest, stomach, or waist, as routinely would happen with hooked or shelf bra construction. This also prevents the aggravation of indigestion, GERD or reflux-type issues that are frequently experienced by large-breasted women as a result of tight bra bands, especially while lying down or sleeping. The garment's unique design also allows for accommodation of an individual woman's own changing breast size throughout weight gain/weight loss/monthly cycles/water retention/pregnancy, etc.

In additional embodiments of the garment, various top designs such as a stand-alone sleeveless top, or a top with sleeves of various lengths can be used in conjunction with the upper portion of the garment. Alternatively, the garment can be used as the integrated top of a nightgown with any length skirt.

The foregoing description merely illustrates the disclosed garment and is not intended to be limiting. It will be apparent to those skilled in the art that various modifications can be made without departing from the inventive concept. Accordingly, it is not intended that the invention be limited except by the appended claims.

The invention claimed is:

1. A garment that provides support to breasts on a person comprising:

an upper portion with breast cups, the upper portion comprising:

a back panel, front panels, and outer breast panels, each one of the front panels structurally functions both as an inner breast panel and a front strap and each one of the front panels is comprised of a single fabric piece; each one of the outer breast panels is comprised of a double fabric piece and connects to the back panel via an outer breast panel/back panel interface; at least one inner breast panel and at least one outer breast panel are connected by a curved seam to form at least one breast cup; whereby each breast cup directs a breast volume forward and supports the breast volume from an outside of a breast to an inside of the breast.

2. The garment in claim 1 further comprised of a plurality of support bands, one end of each support band attaches to the outer breast panel/back panel interface on one side of the garment via a side anchor seam; and a second end of each of the support bands attaches to a top front panel/back panel interface via a shoulder anchor seam on an opposite side of the garment.

3. The garment of claim 2 wherein at least one of the support bands is attached to at least one breast cup via an under-breast seam; the under-breast seam continuing along from the side anchor seam and running up to a release point; wherein the at least one of the support bands becomes detached at the release point; forming a detached pathway from the release point to the top front panel/back panel interface.

4. The garment of claim 2 wherein each of the support bands is comprised of a single, long stretch of fabric sewn together to form a tube of fabric, providing double heft.

5. The garment of claim 3 further comprised of a means to attach each of the support bands at a plurality of points along the detached pathway.

6. The garment of claim 1, wherein the upper portion is comprised of a 4-way stretch fabric.

7. The garment of claim 6 wherein the 4-way stretch fabric is a cotton-spandex fabric.

8. The garment of claim 7 wherein the cotton-spandex fabric is 95% cotton and 5% spandex in composition.

9. The garment of claim 1, wherein the single fabric piece and the double fabric piece are each oriented and cut to allow for more stretch in a side to side orientation rather than in a vertical orientation.

10. The garment of claim 1 wherein the curved seam is a zigzag stitch.

11. The garment of claim 2 wherein the side anchor seam is straight-stitched.

12. The garment of claim 2 wherein the shoulder anchor seam is straight-stitched.

13. The garment of claim 3 wherein the under-breast seam is a zigzag stitch.

14. The garment of claim 1 further comprised of a bodice.

15. The garment of claim 14 wherein the bodice is comprised of vertical panels separated by vertical seaming.

16. The garment of claim 14, wherein the vertical panels are comprised of a 4-way stretch fabric.

17. The garment of claim 16 wherein the 4-way stretch fabric is a cotton-spandex fabric.

18. The garment of claim 17 wherein the cotton-spandex fabric is 95% cotton and 5% spandex in composition.

19. The garment of claim 14, wherein the bodice panels are oriented and cut to allow for more stretch in a side to side orientation rather than in a vertical orientation.

20. The garment of claim 14, whereby an entire front of the bodice is comprised of only one single piece of fabric.

21. The garment of claim 20 further comprised of a belly band.

* * * * *